US007488184B2

(12) United States Patent
Yasuda et al.

(10) Patent No.: US 7,488,184 B2
(45) Date of Patent: Feb. 10, 2009

(54) ELECTRONIC EQUIPMENT AND METHOD OF MANUFACTURING THE ELECTRONIC EQUIPMENT

(75) Inventors: Takeshi Yasuda, Nagoya (JP); Atsushi Nagashima, Kasugai (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/821,199

(22) Filed: Jun. 22, 2007

(65) Prior Publication Data

US 2008/0124970 A1 May 29, 2008

(30) Foreign Application Priority Data

Jun. 22, 2006 (JP) ..... 2006-172312

(51) Int. Cl.
*H01R 12/00* (2006.01)

(52) U.S. Cl. ..... 439/76.1

(58) Field of Classification Search ..... 439/76, 439/77, 76.1, 76.2; 188/444; 318/293
See application file for complete search history.

(56) References Cited

U.S. PATENT DOCUMENTS

| | | | | |
|---|---|---|---|---|
| 5,810,111 | A * | 9/1998 | Takeuchi et al. | 180/443 |
| 6,078,155 | A | 6/2000 | Tominaga et al. | |
| 6,099,325 | A * | 8/2000 | Parkhill | 439/76.1 |
| 6,577,030 | B2 * | 6/2003 | Tominaga et al. | 310/68 B |
| 6,690,582 | B2 * | 2/2004 | Sumida | 361/752 |
| 6,729,887 | B2 * | 5/2004 | Katsumata et al. | 439/39 |
| 6,851,509 | B2 * | 2/2005 | Hayakawa et al. | 180/444 |
| 6,906,483 | B2 | 6/2005 | Tominaga et al. | |
| 7,021,418 | B2 * | 4/2006 | Tominaga et al. | 180/444 |
| 7,064,509 | B1 * | 6/2006 | Fu et al. | 318/400.23 |
| 7,081,691 | B2 * | 7/2006 | Kawata | 307/9.1 |
| 7,177,154 | B2 * | 2/2007 | Lee | 361/704 |
| 7,312,545 | B2 * | 12/2007 | Sasaki et al. | 310/68 R |
| 2002/0074148 | A1 | 6/2002 | Murakoshi et al. | |
| 2005/0167183 | A1 * | 8/2005 | Tominaga et al. | 180/444 |
| 2006/0067064 | A1 | 3/2006 | Crews et al. | |

FOREIGN PATENT DOCUMENTS

| | | |
|---|---|---|
| EP | 0 907 223 A2 | 4/1999 |
| EP | 1 215 756 A1 | 6/2002 |

OTHER PUBLICATIONS

European Search Report issued in European Application No. EP 07 01 0821 dated Nov. 20, 2007, 5 pages.

* cited by examiner

*Primary Examiner*—T C Patel
*Assistant Examiner*—Vladimir Imas
(74) *Attorney, Agent, or Firm*—Osha • Liang LLP

(57) ABSTRACT

To prevent lowering of connection reliability of soldering connection portions of electronic equipment, there is provided electronic equipment which is equipped with a connector electrically connected to an electric motor, a control board and a power module board to which the connectors and other electric parts are electrically connected by soldering, a base for supporting the boards and the connector while overlapped with the boards and cases for fixing the connector while the connector is exposed from an opening portion, and fixing the boards while the boards and the base are accommodated in the cases. The connector is supported by the base through a beam as a flexible metal piece.

6 Claims, 13 Drawing Sheets

ELECTRONIC EQUIPMENT AND METHOD OF MANUFACTURING THE ELECTRONIC EQUIPMENT

BACKGROUND OF THE INVENTION

1. Field of the Invention

The present invention relates to electronic equipment equipped with a connector which is electrically connected to a device to be connected.

2. Description of Related Art

An electronic control unit (ECU: Electronic Control Unit) of an electrical motor-driven type power steering device mounted in a vehicle as disclosed in JP-A-2000-203437 and JP-A-2003-267233 (patent documents 1 and 2) is known as electronic equipment equipped with a connector. This electronic control unit is connected to an electrical motor by a screw or the like, and they are electrically connected to each other through a connector. The electronic control unit controls the driving of the electrical motor so that steering assisting torque corresponding to a steering operation is produced in the steering shaft.

In the patent document 1, an electrically conductive plate is subjected to insert molding using insulating resin to integrally form a housing and a connector, and the housing, a control board and a metal board are overlapped with one another and electrically connected to one another by soldering. The hosing and the respective boards are accommodated in a case, and the connector is projected from the case. In the patent document 2, a connector is fixed onto a case by a screw, and the terminal of the connector projecting into the case is electrically connected to the control board by soldering. A large current board is formed by subjecting an electrically conductive member to insert molding using insulating resin. The large current board, the control board and the metal board are overlapped with one another, electrically connected to one another by soldering and accommodated in the case.

In the related art structure as shown in the patent document 1, the housing accommodated in the case and the connector exposed from the case are integral with each other. Therefore, when external force is applied to the connector because a partner connector is attached/detached to/from the connector or a foreign matter impinges against the connector, the external force is directly transferred from the connector to the housing, and stress is applied to the soldering-connection portions of the housing, the control board and the metal board, and thus there is a risk that the soldering is broken and the connection reliability is lowered. Furthermore, in the related art structure as shown in the patent document 2, the connector is fixed onto the case by the screw, and the terminal of the connector is connected to the control board in the case by soldering. Therefore, when external force is applied to the connector because of a dimensional error among respective parts, an assembly error or the like, stress is applied to the soldering-connection portions of the terminal of the connector and the control board and resides, and also stress is applied to the soldering-connection portions of the control board, the large current board and the metal board and resides. Therefore, there is a risk that the soldering is broken with time lapse and the connection reliability is lowered. Furthermore, in the related art structures shown in the patent documents 1, 2, when external is applied to the connector due to the difference in thermal shrinkage characteristic among materials of respective parts, stress is applied to the soldering-connection portions of the housing, the board and the connector, and thus there is a risk that the soldering is broken and thus the connection reliability is lowered.

SUMMARY OF THE INVENTION

The present invention has been implemented to solve the above problem, and has an object to provide electronic equipment and electronic equipment manufacturing method which can prevent lowering of connection reliability of soldering-connection portions.

Electronic equipment according to the present invention comprises a connector for electrically connecting a device to be connected, a board to which the connector is electrically connected and which has a soldering-connection portion, a base that is overlapped with the board to support the board and the connector, and a case for fixing the connector while the connector is exposed from an opening portion thereof and fixing the board and the base while the board and the base are accommodated therein, wherein the base supports the connector through a flexible member.

Accordingly, the connector is fixed to the case and it is supported through the flexible member by the base. Therefore, even when external force is applied to the connector due to the attachment/detachment of the partner connector to/from the connector or the impingement of foreign matters against the connector, the dimensional error or assembly error of the respective parts, the difference in thermal shrinkage characteristic among the materials of the respective parts or the like, the connector does not jounce (move) with respect to the case, the base and the board, and the external force is absorbed by the flexible member, so that the external force is not transferred to the base and the board. Therefore, stress with which soldering may be broken is not applied to the soldering connection portions of the connector and the board, and thus the connection reliability at the soldering connection portions can be prevented from being lowered.

According to an embodiment of the present invention, in the above electronic equipment, an electrically conductive metal piece constituting a terminal of the connector and a flexible metal piece constituting the flexible member are subjected to insert molding using insulating resin so that the connector and the base are formed integrally with each other, and then the continuous insulating resin portion is cut out, whereby the connector and the base are connected to each other by only the flexible metal piece.

In the above construction, the connector and the base are manufactured by the same mold at the same time, and thus the manufacturing cost can be reduced. Furthermore, it is unnecessary to assemble the connector to the base and thus the connector and the base can be assembled to the case and the board in a lump, so that the number of assembling steps of the electronic equipment can be reduced, and the assembling work can be facilitated.

Furthermore, in the embodiment of the present invention, the flexible member has a bending portion in the electronic equipment.

In the above construction, the effective length of the flexible member can be increased, and the external force applied to the connector can be surely absorbed by the flexible member. Furthermore, the width dimension of the flexible member which directs from the connector to the base is reduced to thereby reduce the interval between the connector and the base, so that the electronic equipment can be miniaturized.

According to the embodiment of the present invention, in the above electronic equipment, the board comprises a first board that is supported while overlapped with the upper side of the base, and a second board that is supported while overlapped with the lower side of the base, the first board and the second board are electrically connected to each other by soldering, and the connector is electrically connected to at least one of the first board and the second board by soldering.

In the above construction, the connector is fixed to the case, and supported through the flexible member by the base. Therefore, stress which may break soldering is not applied to the soldering connection portions of the connector and each board, and the connection reliability of the soldering connection portions can be prevented from being lowered.

According to the present invention, there is provided a method of manufacturing electronic equipment comprising a connector electrically-connected to a device to be connected, a board having a soldering-connection portion to which the connector is electrically connected, a base for supporting the board and the connector while overlapped with the board, and a case for fixing the connector while the connector is exposed from an opening portion thereof and fixing the board and the base while the board and the base are accommodated in the case, in which an electrically conductive metal piece constituting a terminal of the connector and a flexile metal piece are subjected to insert-molding using insulating resin so that the connector and the base are formed integrally with each other, and then a continuous resin portion is cut out.

According to the above method, the connector and the base can be manufactured by the same mold at the same time, it is unnecessary to assemble the connector to the base, and the connector and the base can be assembled to the case and the board in a lump. Therefore, the manufacturing cost can be reduced, the number of assembling steps of the electronic equipment can be reduced, and the assembly work can be facilitated. Furthermore, even when external force is applied to the connector under the assembly state of the electronic equipment, the connector does not jounce and the external force is absorbed by the flexible member, so that no external force is transferred to the base and the board. Therefore, stress which may break soldering is not applied to the soldering connection portions of the connector, the board, etc., and thus the reduction in connection reliability can be prevented.

Furthermore, according to the embodiment of the present invention, in the electronic equipment manufacturing method, after the connector, the board and the base are fixed to the case, the connector and the board are electrically connected to each other by soldering.

According to the above construction, external force applied to the connector due to the dimensional error or assembly error of the respective parts or the like can be absorbed by the flexible member, and it is prevented from being transferred to the base and the board. Therefore, the connector and the board can be connected to each other by soldering. Accordingly, stress caused by the external force is not applied to the soldering connection portions, and thus the soldering is not broken, so that the connection reliability of the soldering connection portions can be surely prevented from being lowered.

According to the present invention, even when the external is applied to the connector, the connector does not jounce with respect to the case, the base and the board, and the external force is absorbed by the flexible member, so that no external force is transferred to the base and the board. Accordingly, stress which may break soldering is not applied to the soldering connection portions of the connector, the board, etc., and the connection reliability of the soldering connection portions can be prevented from being lowered.

DESCRIPTION OF PREFERRED EMBODIMENTS

Figure 1:
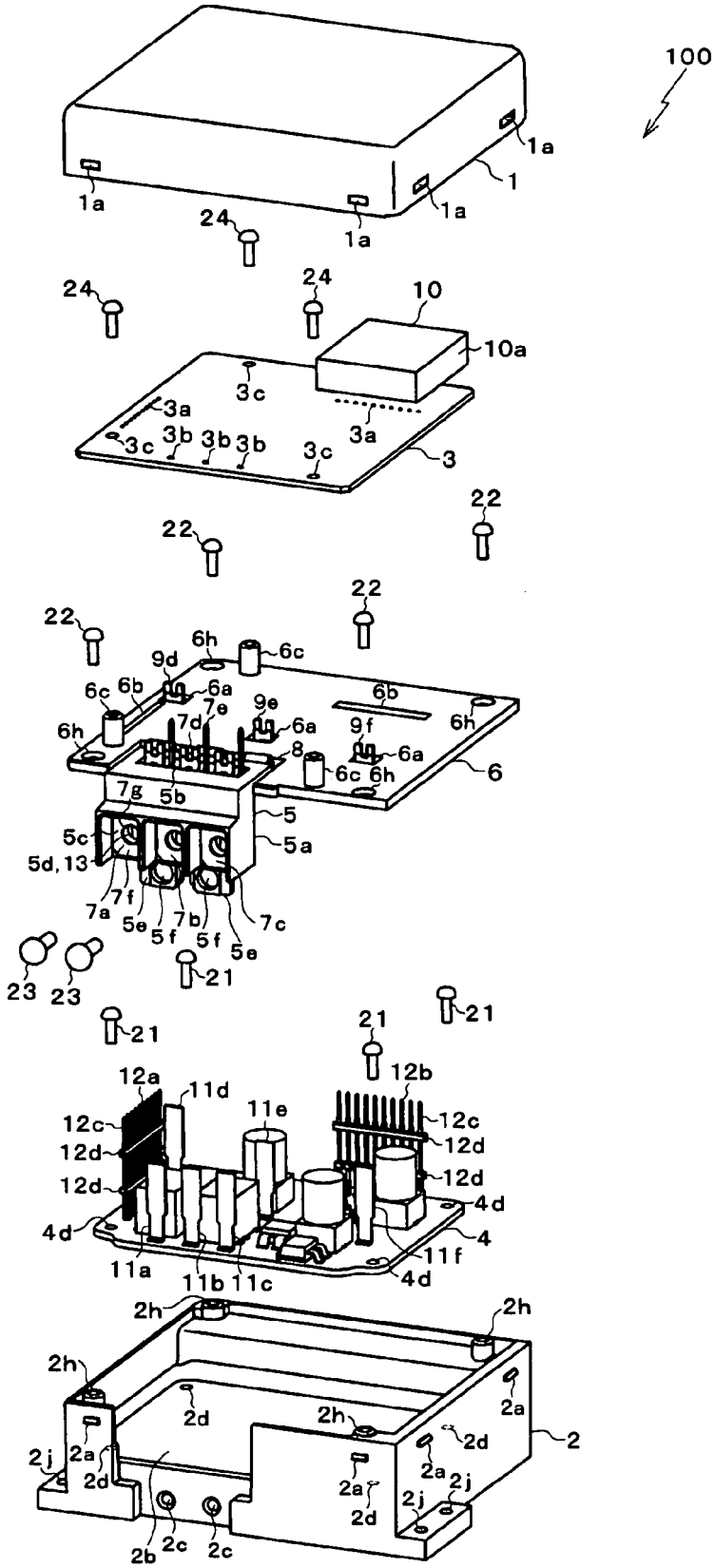
FIG. 1 is an exploded view of electronic equipment according to an embodiment of the present invention.

FIG. 1 is an exploded diagram showing electronic equipment 100 according to an embodiment of the present invention. The electronic equipment 100 is an electronic control unit (ECU: Electronic Control Unit) of an electrical motor-driven type power steering device mounted in a vehicle. The electrical motor-driven type power steering device comprises the electronic equipment 100, and a three-phase type electrical motor 90 (shown in FIG. 12) for producing steering assisting torque corresponding to the manipulation of the steering for the steering shaft of the vehicle (not shown). The electronic equipment 100 is mechanically and electrically connected to the electric motor 90, and controls the driving of the electric motor 90.

1, 2 represent divisional type upper and lower cases. The upper case 1 is formed of a steel plate, and the lower case 2 is formed by aluminum die cast. Lock holes 1*a* are provided to the respective side surfaces of the upper case 1, and lock projections 2*a* are provided to the respective side surfaces of the lower case 2. The respective lock holes 1*a* of the upper case 1 and the respective lock projections 2*a* of the lower case 2 are engagedly fitted to one another, thereby assembling the cases 1, 2 (shown in FIG. 12).

3 represents a control board. The control board 3 is formed of glass epoxy resin. Electrical parts for controlling the driving of the electrical motor 90, etc. are mounted on each mount surface of the control board by soldering and an electrical circuit is also formed (a part thereof is omitted from the illustration). A connector 10 is an example of the electrical parts mounted on the control board 3. The connector 10 comprises terminals of metal pieces having electrical conductivity (not shown) and a housing 10*a* formed of resin having insulation. The terminals of the connector 10 are held in the housing 10*a*, and electrically connected onto the control board 3 by soldering. A connector connected to a cable to be electrically connected to a battery, sensors, other controllers, etc. of a vehicle (not shown) is fitted to the connector 10. An opening (not shown) is formed at the side surface of the upper case 1 so that the connector 10 is projected to the outside of the cases 1, 2.

4 represents a power module board. The power module board 4 is formed of an aluminum plate. Electrical parts for supplying driving current to the electrical motor 90 are mounted on each mount surface of the power module board 4 by soldering, and an electrical circuit is also formed (a part thereof is omitted form the illustration). Terminals 11*a* to 11*f* and connectors 12*a*, 12*b* are provided as examples of the electrical parts mounted on the power module board 4. The terminals 11*a* to 11*f* comprise plate-shaped metal pieces having electrical conductivity. The lower ends of terminals 11*a* to 11*f* are electrically connected onto the power module board 4 by soldering, spot welding or the like so that the terminals 11*a* to 11*f* stand vertically to the power module board 4. The connector 12*a*, 12*b* comprises terminals 12*c* formed of pin-shaped metal pieces having electrical conductivity and base frames 12*d* formed of resin having insulation. The respective terminals 12*c* of the connectors 12*a*, 12*b* are held at a predetermined pitch by the base frames 12*d*, and electrically connected onto the power module board 4 by soldering. Through holes 3*a* through which the respective terminals 12*c* of the connectors 12*a*, 12*b* penetrate are formed in the control board 3.

Figure 2:
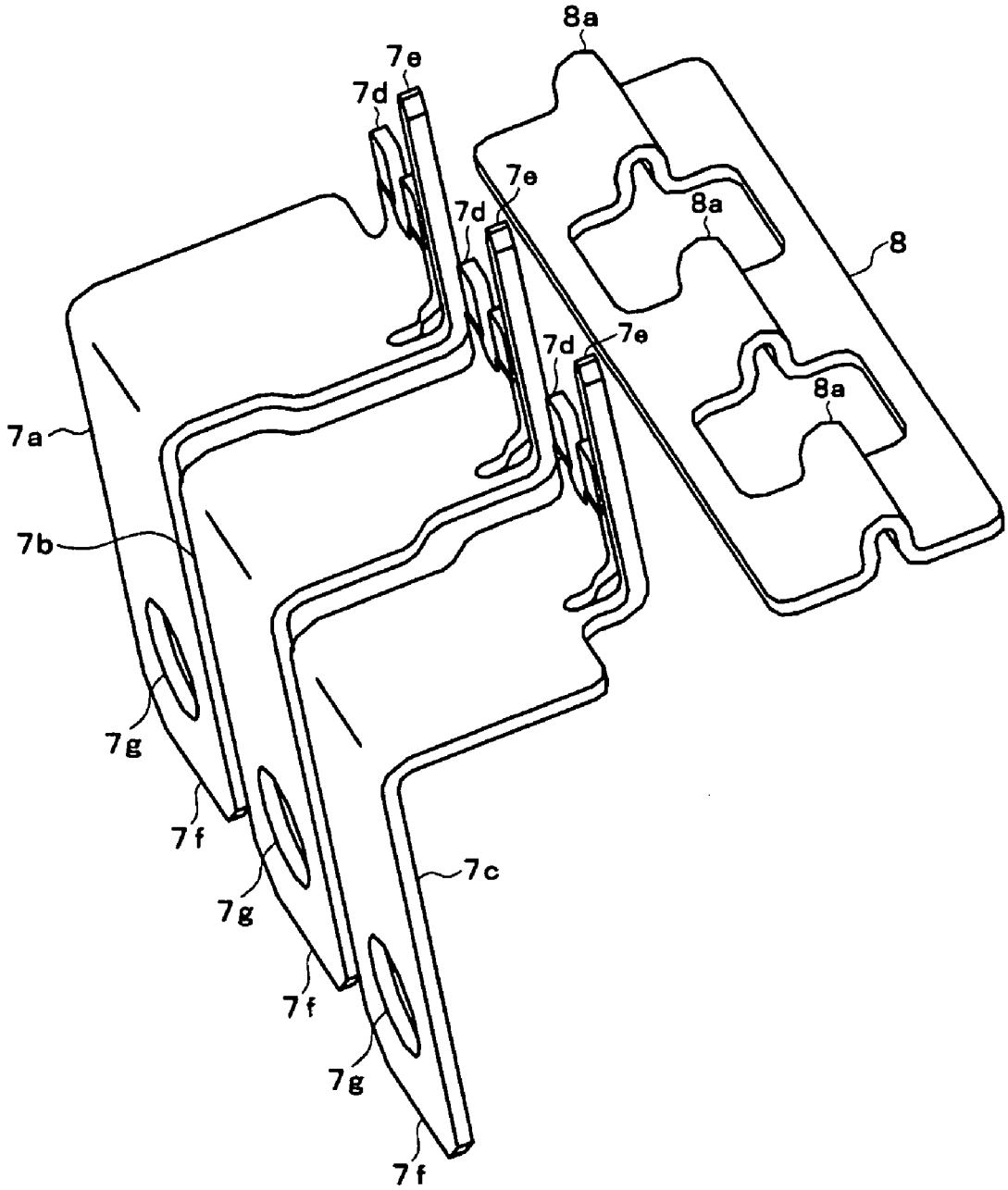
FIG. 2 is a diagram showing terminals of a connector equipped to the electronic equipment and a beam for connecting the connector and a base.

5 represents a connector. 6 represents a base. The connector 5 serves to electrically connect the connector 5 and the electrical motor 90. The base 6 is overlapped with the boards 3, 4 to support the boards 3, 4 and the connector 5. The base 6 is designed to be larger in outer diameter than the boards 3, 4. The connector 5 and the base 6 are integrally formed with each other by subjecting the metal pieces to insert-molding using insulating resin. Terminals 7*a* to 7*c*, 9*d* to 9*f* and a beam 8 are provided as examples of the insert-molded metal pieces. The terminals 7*a* to 7*c*, 9*d* to 9*f* and the beam 8 are formed of plate-shaped metal pieces having electrical conductivity, flexibility and elasticity. The terminals 7*a* to 7*c* and the beam 8 are designed to have shapes as shown in FIG. 2.

The terminals 7*a* to 7*c* constitute the terminals of the connector 5. The terminals 7*a* to 7*c* are insulated by the housing 5*a* formed of insulating resin of the connector 5. The upper portion of the housing 5*a* is provided with a hole 5*b* through which the upper end portions 7*d*, 7*e* of the terminals 7*a* to 7*c* are projected and the terminals 11*a* to 11*c* of the power module board 4 penetrate. The control board 3 is provided with a hole 3*b* through which the upper end portions 7*e* of the terminals 7*a* to 7*c* penetrate. Recesses 5*c* through which the lower end portions 7*f* of the terminals 7*a* to 7*c* are formed at the side portion of the housing 5*a*. Holes 7*g* are formed at the lower end portions 7*f* of the terminals 7*a* to 7*c*. Holes 5*d* are formed in the respective recesses 5*c* of the housing 5*a* so as to be concentric to the holes 7*g*. A metal nut 13 (see FIG. 8B) is mounted in each hole 5*d*. Holes 5*f* are formed at the lower end portions 5*e* of the housing 5*a* as shown in FIG. 1. An opening portion 2*b* through which the connector 5 is projected to the outside of the cases 1, 2 and also screw holes 2*c* for fixing the connector 5 are formed at the side surface of the lower case 2.

The connector 5 and the base 6 are joined to each other at the insulating portions thereof by only the beam 8. That is, the base 6 supports the connector 5 through the beam 8. As shown in FIG. 2, the beam 8 has bending portions 8*a* at the center thereof. The bending portions 8*a* are exposed from the insulating resin portions of the connector 5 and the base 6. The beam 8 and the terminals 7*a* to 7*c* are insulated from each other by the housing 5*a* of the connector 5. The base 6 is provided with a hole 6*a* through which the terminals 9*d* to 9*f* are projected and the terminals 11*d* to 11*f* of the power module board 4 penetrate as shown in FIG. 1. Furthermore, the base 6 is also provided with a hole 6*b* through which the connectors 12*a*, 12*b* penetrate. Still furthermore, a cylinder 6*c* is formed on the base 6. A metal nut 14 (shown in FIG. 8A) is mounted in the cylinder 6*c*.

FIGS. 3A to 8B are diagrams showing the manufacturing state of the connector 5 and the base 6. FIGS. 3A, 4A, 5A, 6A, 7A and 8A show the state of the formation process of the connector 5 and the base 6 when viewed from the upper side in the neighborhood of the connector 5. FIGS. 3B, 4B, 5B, 6B, 7B and 8B are X-X cross-sectional views of FIGS. 3A, 4A, 5A, 6A, 7A and 8A.

Figure 3A:
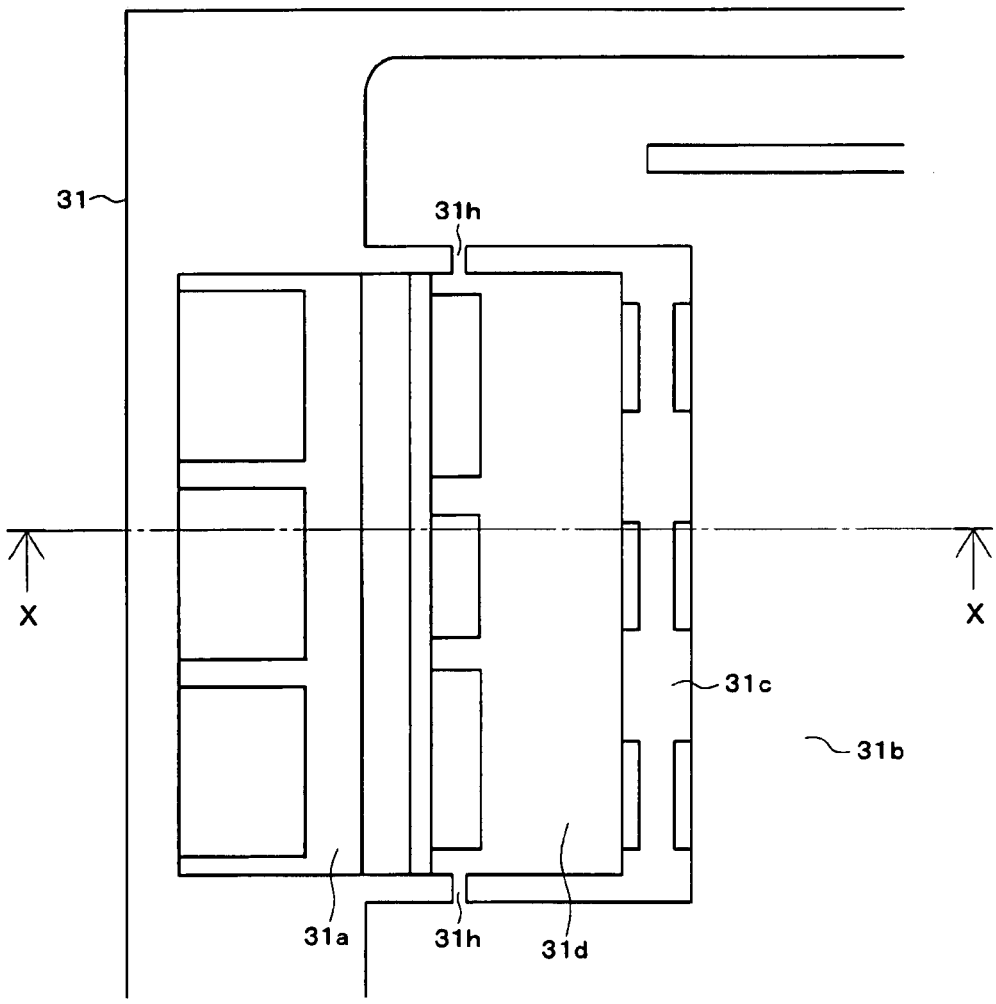
FIG. 3A is a diagram showing a manufacturing state of the connector and the base equipped to the electronic equipment.
Figure 3B:
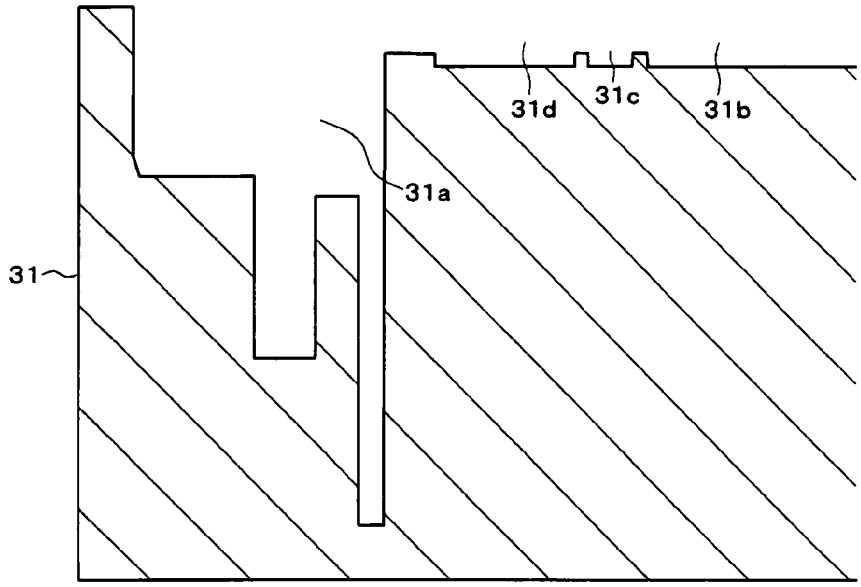
FIG. 3B is a cross-sectional view taken along X-X of FIG. 3A.
Figure 4A:
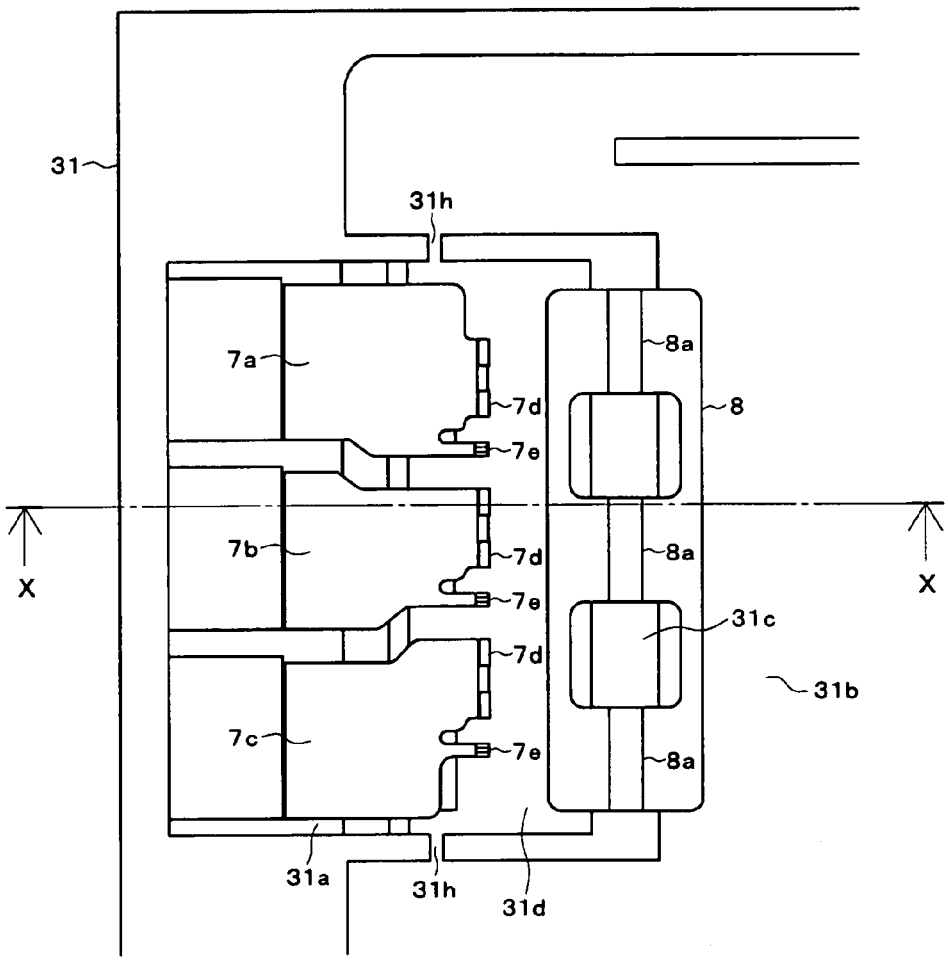
FIG. 4A is a diagram showing a manufacturing state of the connector and the base equipped with the electronic equipment.
Figure 4B:
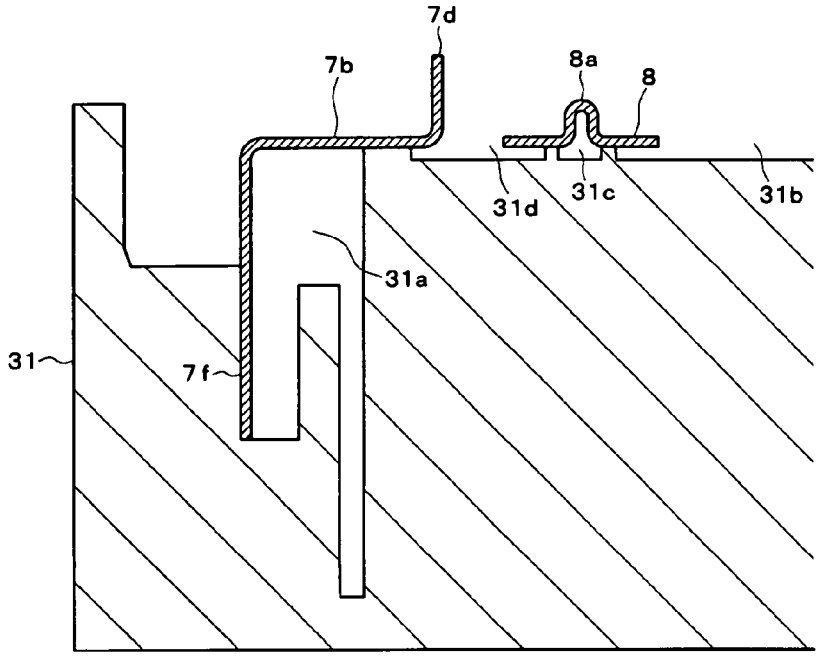
FIG. 4B is a cross-sectional view taken along X-X of FIG. 4A.
Figure 5A:
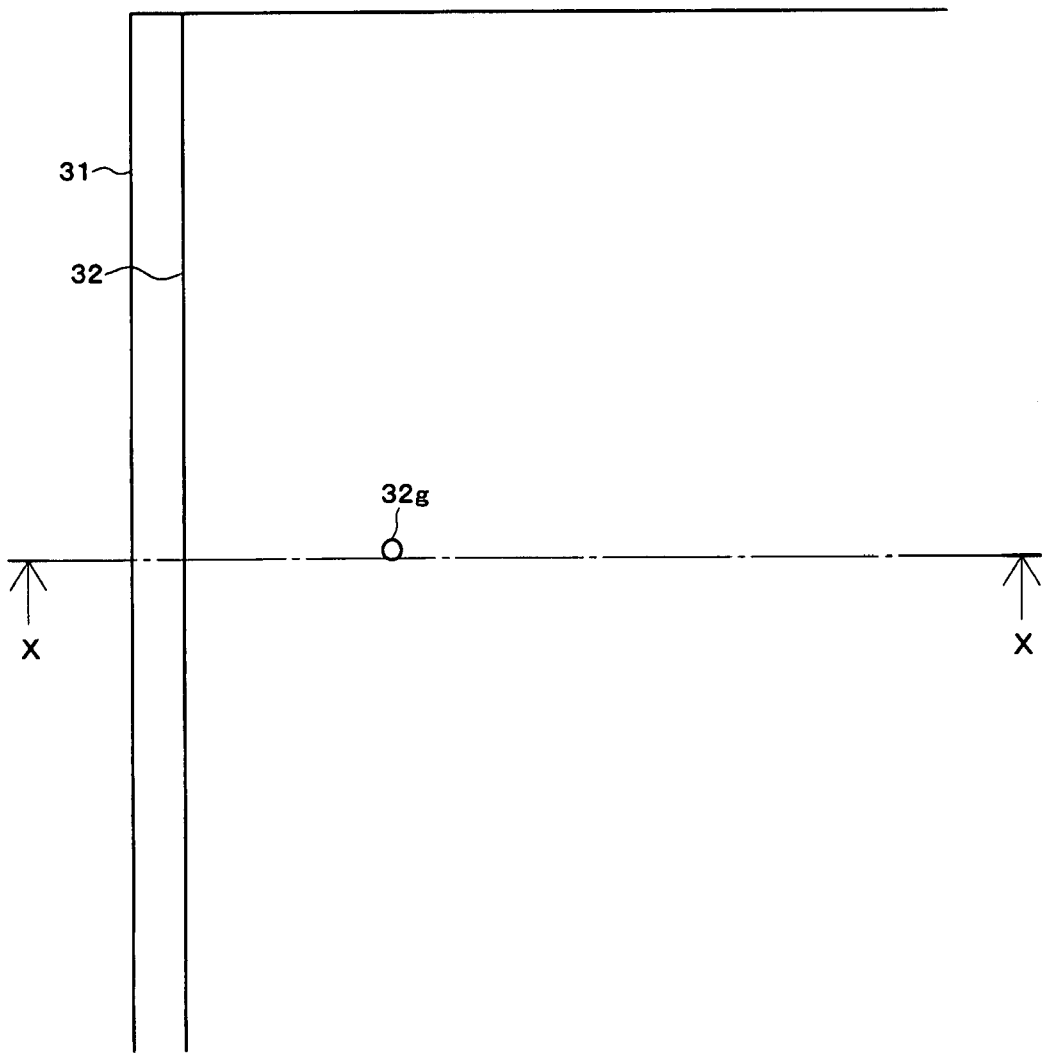
FIG. 5A is a diagram showing a manufacturing state of the connector and the base equipped with the electronic equipment.
Figure 5B:
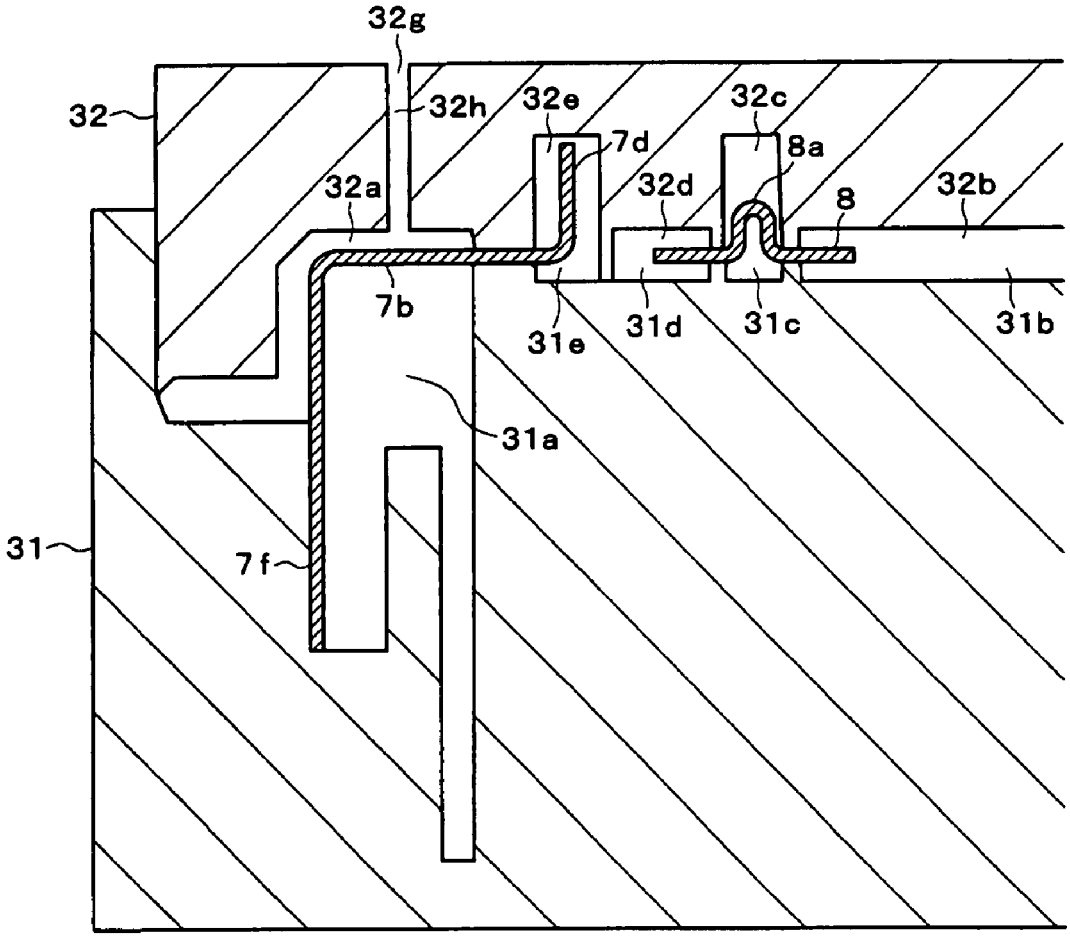
FIG. 5B is a cross-sectional view taken along X-X of FIG. 5A.

After an insert-molding lower metal mold 31 shown in FIG. 3A, etc. and an insert-molding upper metal mold 32 shown in FIG. 5A, etc. are secured to an insert molding machine (not shown), the terminals 7*a* to 7*b* are disposed at a portion 31*a* of the lower metal mold 31 where the connector 5 is formed as shown in FIGS. 4A and 4B, and the beam 8 is disposed at a portion 31*c* where the gap between the connector 5 and the base 6 is formed. At this time, the terminals 9*d* to 9*f* are also disposed at a portion (not shown) of the lower metal mold 31 where the neighboring of the hole 6*a* of the base 6 is formed. Subsequently, as shown in FIGS. 5A and 5B, the lower metal mold 31 and the upper metal mold 32 are mated with each other, and clamped under predetermined pressure.

Figure 6A:
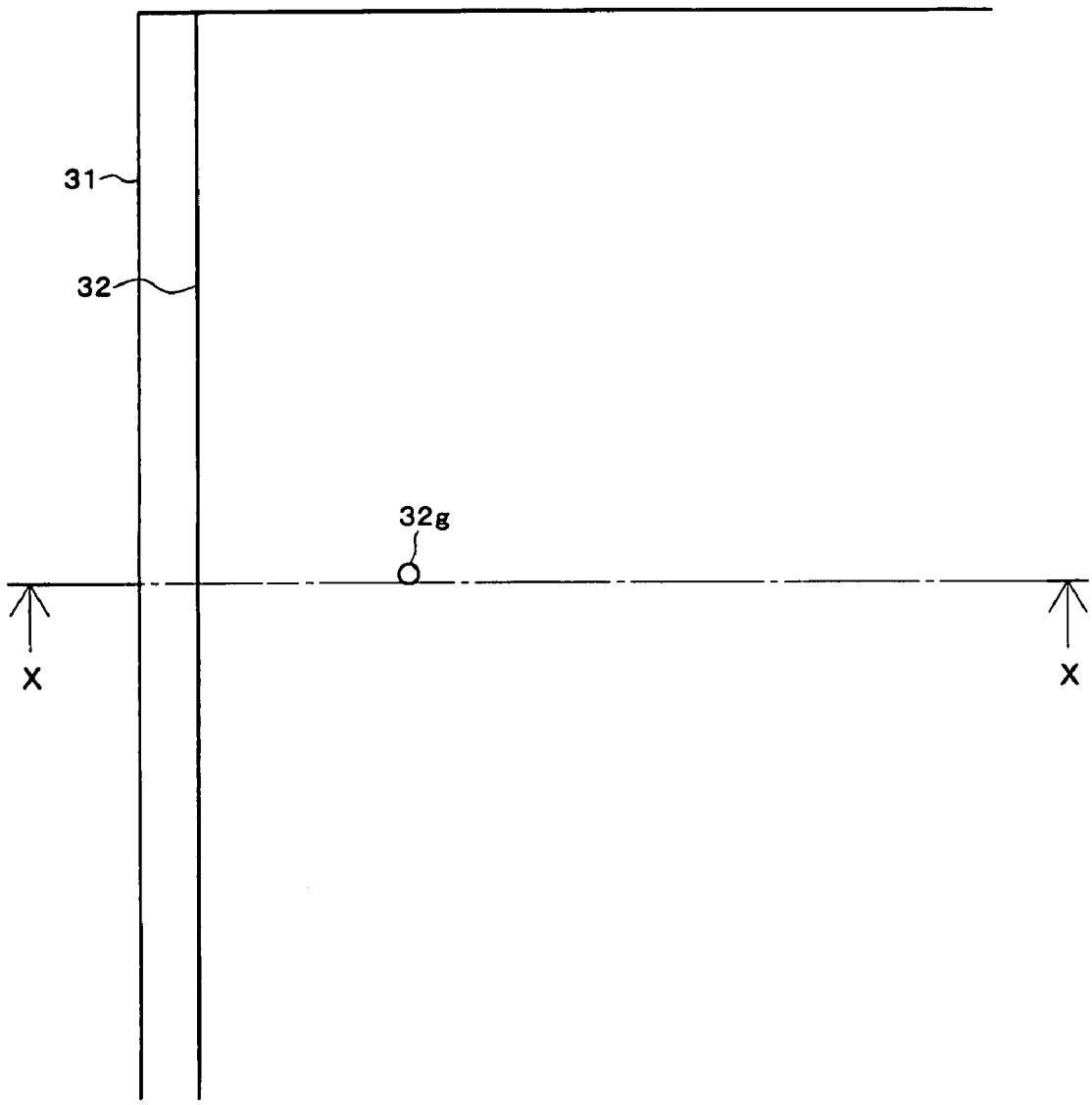
FIG. 6A is a diagram showing a manufacturing state of the connector and the base equipped with the electronic equipment.
Figure 6B:
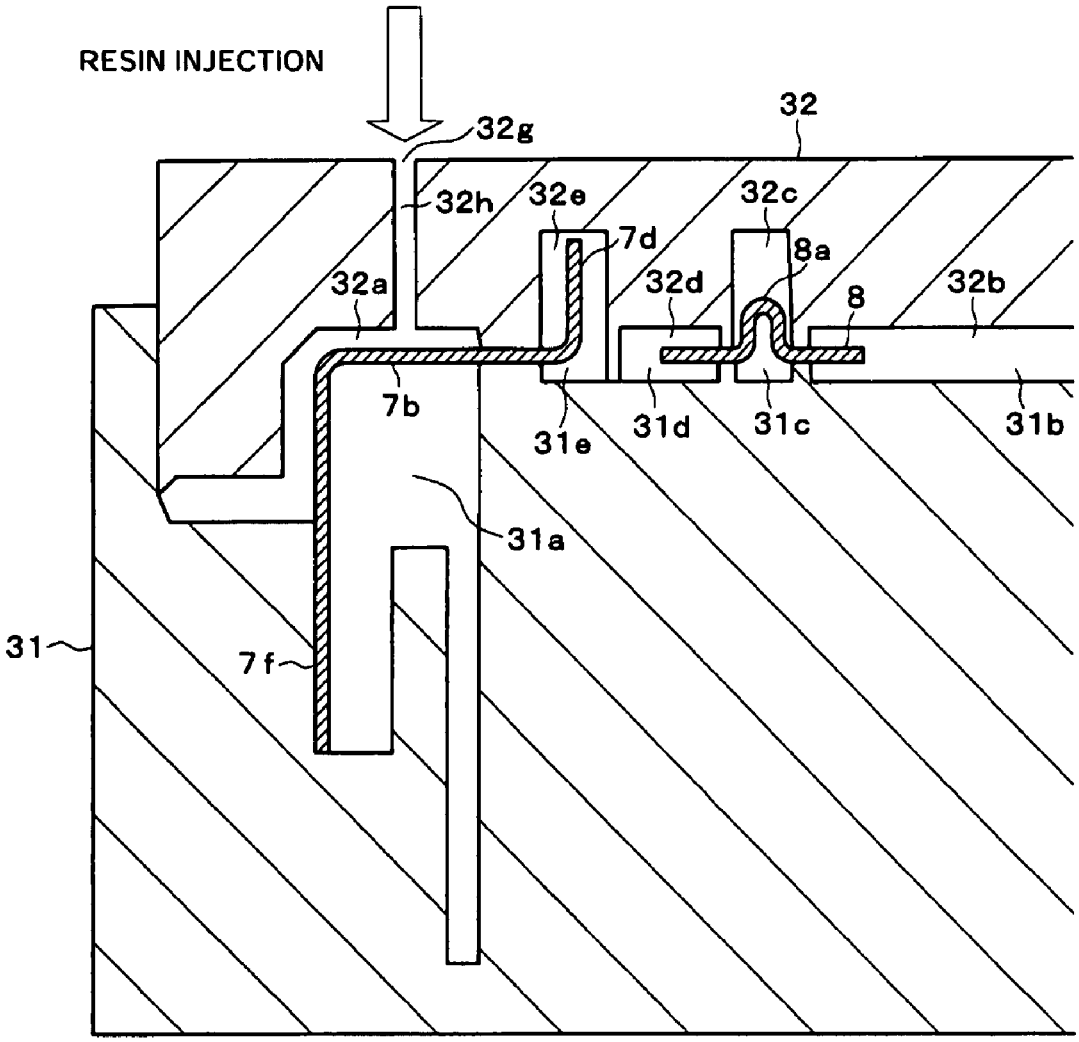
FIG. 6B is a cross-sectional view taken along X-X of FIG. 6A.

Subsequently, as shown in FIGS. 6A and 6B, liquid insulating resin is injected from an injection port 32*g* formed in the upper metal mold 32 through a flow path 32*h*, and portions 31*a*, 32*a*, 31*b*, 32*b*, 31*d*, 32*d* of the metal molds 31, 32 at which the connector 5 and the base 6 will be formed is filled with the insulating resin. The portions 31*c*, 32*c*, 31*e*, 32*e* of the metal molds 31, 32 serve as space portions through which the bending portions 8*a* of the beam 8 and the upper end portions 7*d*, 7*e* of the terminals 7*a* to 7*c* are exposed from the connector 5 and the base 6. The injected liquid insulating resin flows from the connector 5 forming portions 31*a*, 32*a*, 31*d*, 32*d* of the metal molds 31, 32 through the flow path 31*h* shown in FIG. 4A, etc. into the base 6 forming portions 31*b*, 32*b*. Plural injection ports other than the injection port 32*g* may be formed in the metal molds 31, 32 so that liquid insulating resin is injected from the injection ports concerned.

Figure 7A:
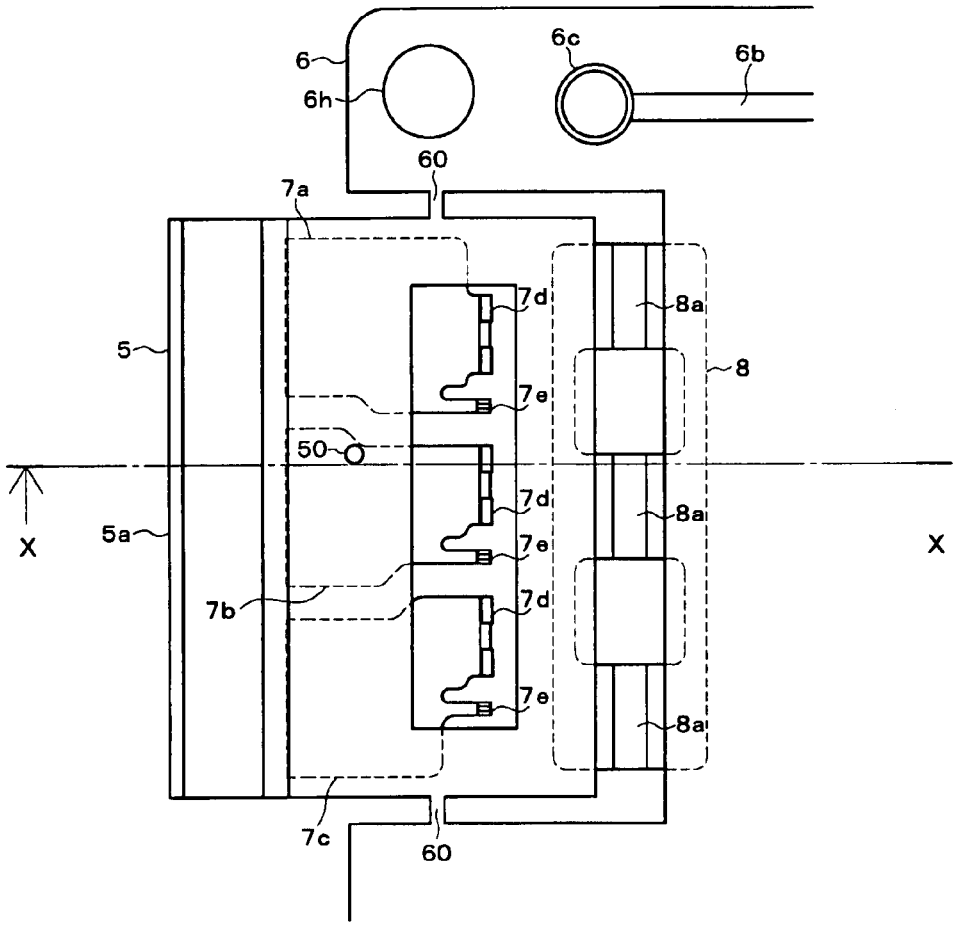
FIG. 7A is a diagram showing a manufacturing state of the connector and the base equipped with the electronic equipment.
Figure 7B:
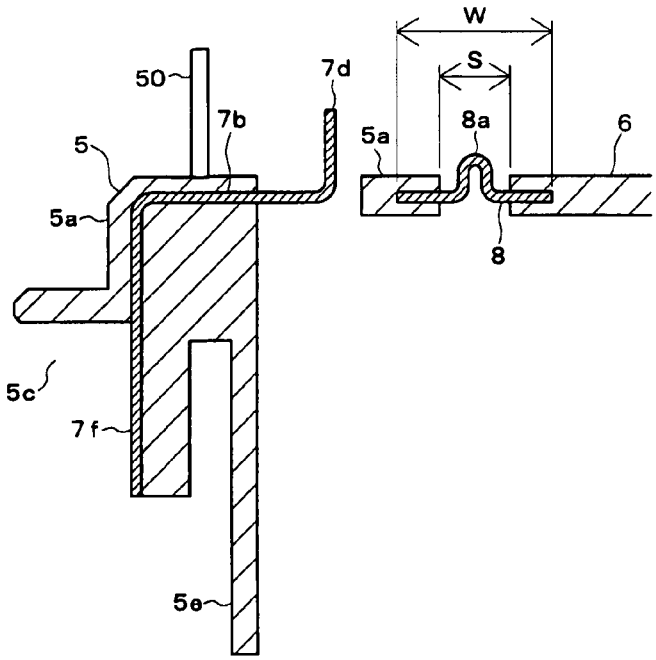
FIG. 7B is a cross-sectional view taken along X-X of FIG. 7A.
Figure 8A:
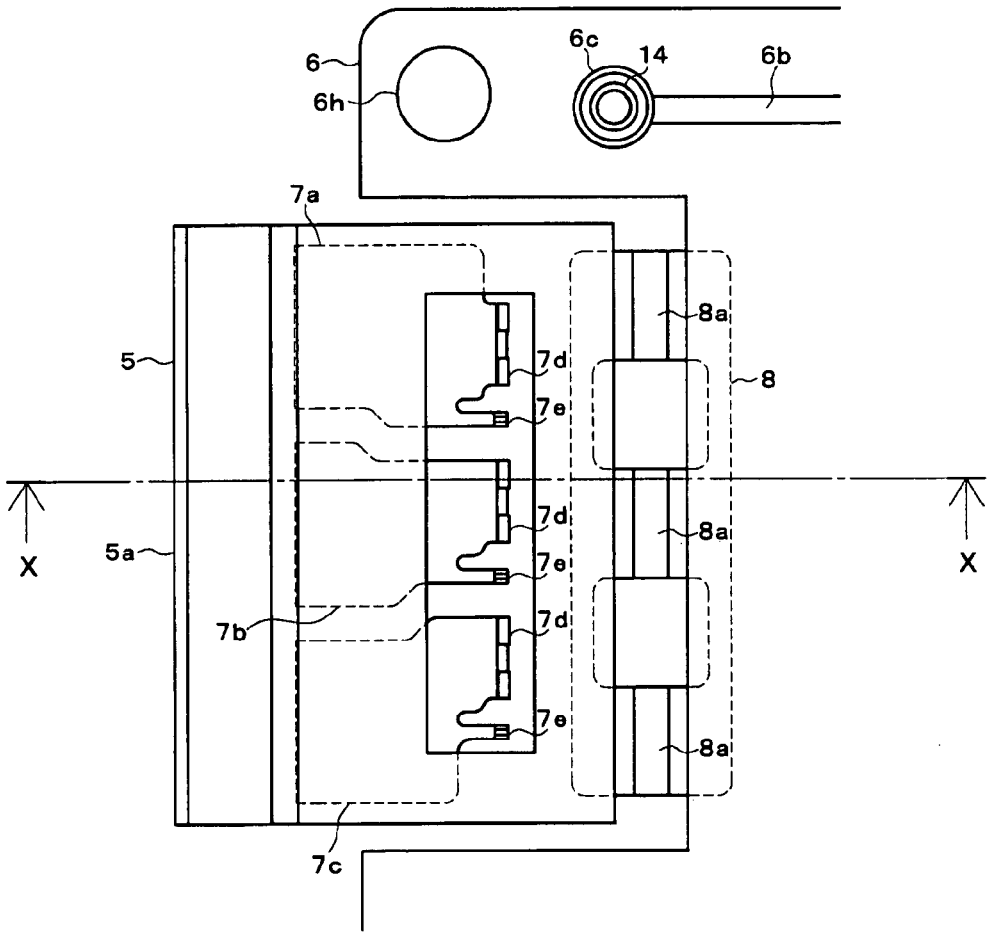
FIG. 8A is a diagram showing a manufacturing state of the connector and the base equipped with the electronic equipment.
Figure 8B:
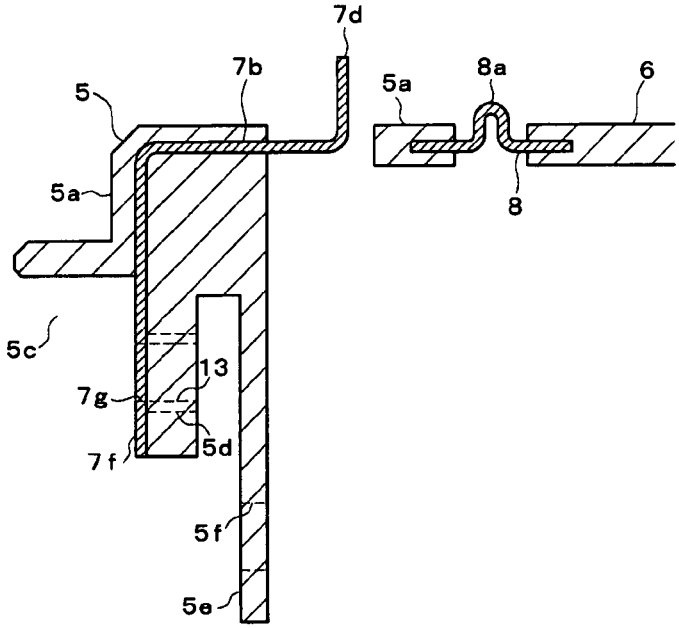
FIG. 8B is a cross-sectional view taken along X-X of FIG. 8A.

When the insulating resin filled between the metal molds 31 and 32 is solidified, the metal molds 31, 32 are opened, and the connector 5 and the base 6 are detached from the metal molds 31, 32 as shown in FIG. 7A and FIG. 7B. Then, a continuous insulating resin portion 60 of the connector 5 and the base 6 which is solidified in the flow path 31*h* of the lower metal mold 31, and unnecessary insulating resin portions such as an insulating resin portion 50 which is solidified in the flow path 32*h* of the upper metal mold 32 and continuous with the connector 5, etc. are cut out as shown in FIG. 8A and FIG. 8B. Accordingly, the connector 5 and the base 6 are formed at the same time, and the connector 5 is supported through only the beam 8 by the base 6. Thereafter, a nut 14 is mounted and fixed in the cylinder 6*c* of the base 6. Furthermore, nuts 13 are mounted and fixed in the holes 5*d* intercommunicating with the holes 7*g* of the terminals 7*a* to 7*c* of the connector 5. Before the metal molds 31, 32 are mated to each other and clamped, the nuts 13, 14 may be disposed at portions (not shown) of the lower metal mold 31 at which the holes 5*d* will be formed and at a portion (not shown) of the upper metal mold 32 at which the inside of the cylinder 6*c* will be formed, and then insert-molding using insulating resin may be carried out.

Figure 9:
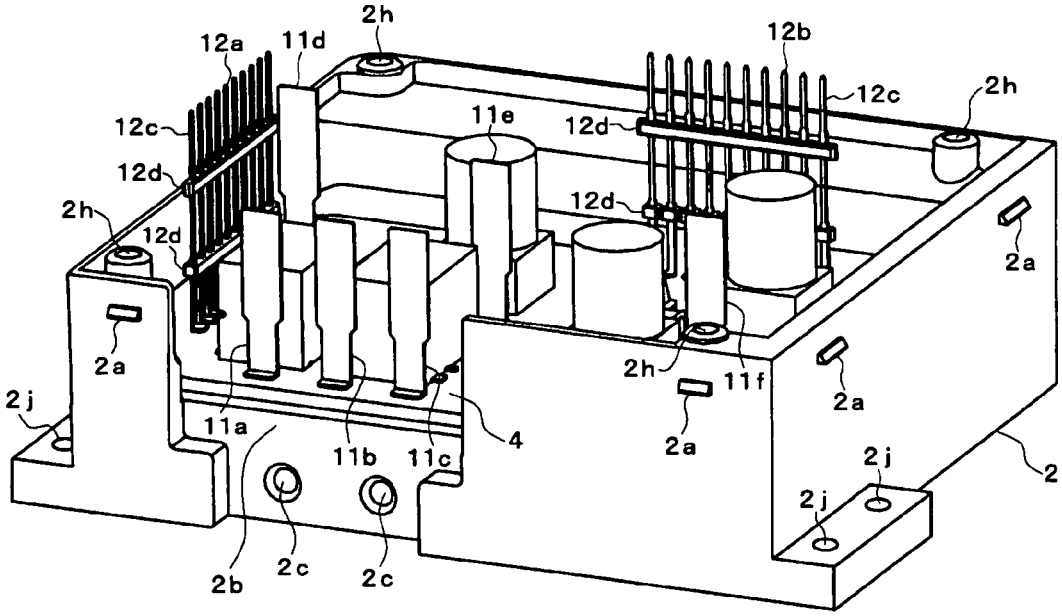
FIG. 9 is a diagram showing an assembly state of the electronic equipment.
Figure 10:
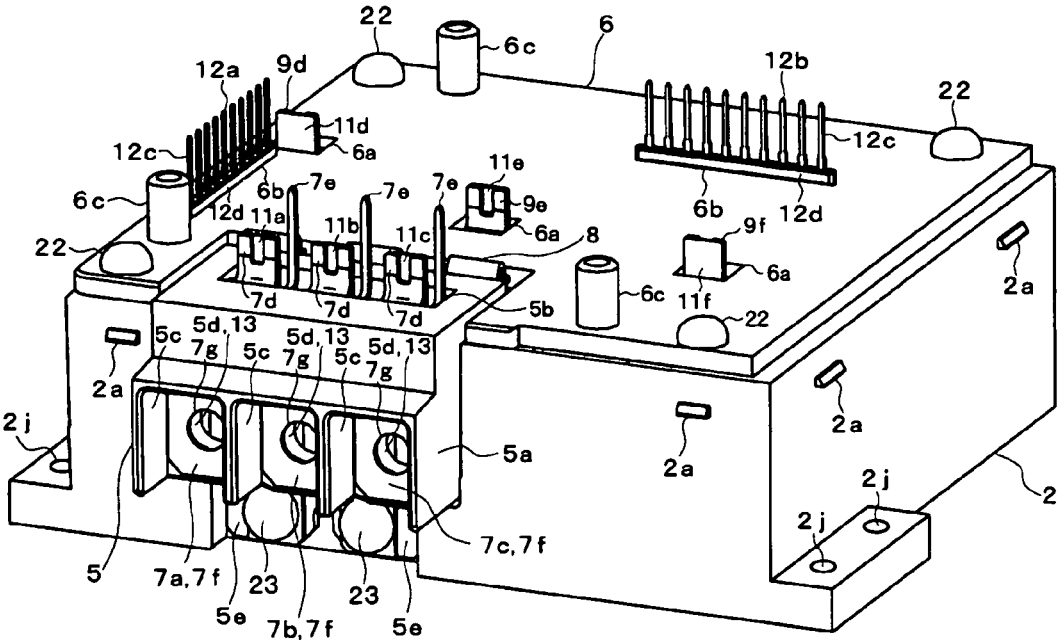
FIG. 10 is a diagram showing an assembly state of the electronic equipment.

FIGS. 9 to 12 are diagrams showing the assembly state of the electronic equipment 100. First, the power module board 4 is mounted in the lower case 2 shown in FIG. 1. Then, screws 21 are made to penetrate through holes 4*d* formed in the power module board 4 and threadably mounted in screw holes 2*d* formed in the lower case 2, whereby the power module board 4 is fixed to the lower case 2 as shown in FIG. 9. Subsequently, the terminals 11*a* to 11*f* of the power module board 4 and the connectors 12*a*, 12*b* are made to penetrate through the holes 6*a*, 6*b* of the base 6 and the holes 5*b* of the connector 5, the base 6 is mounted on the lower case 2, and the connector 5 is disposed at the opening portion 2*b* of the lower case 2. Then, screws 22 are made to penetrate through holes 6*h* formed in the base 6, and threadably mounted in screw holes 2*h* formed in the lower case 2, whereby the base 6 is fixed to the lower case 2 as shown in FIG. 10. Furthermore, screws 23 are made to penetrate through holes 5*f* formed in the connector 5, and threadably mounted in screw holes 2*c* formed in the lower case 2, thereby fixing the connector 5 to the lower case 2. The fixing of the connector 5 to the lower case 2 may be carried out before or after the base 6 is fixed to the lower case 2. Furthermore, the fixing of the connector 5 and the base 6 to the lower case 2 may be carried out at the same time with being adjusted.

Figure 11:
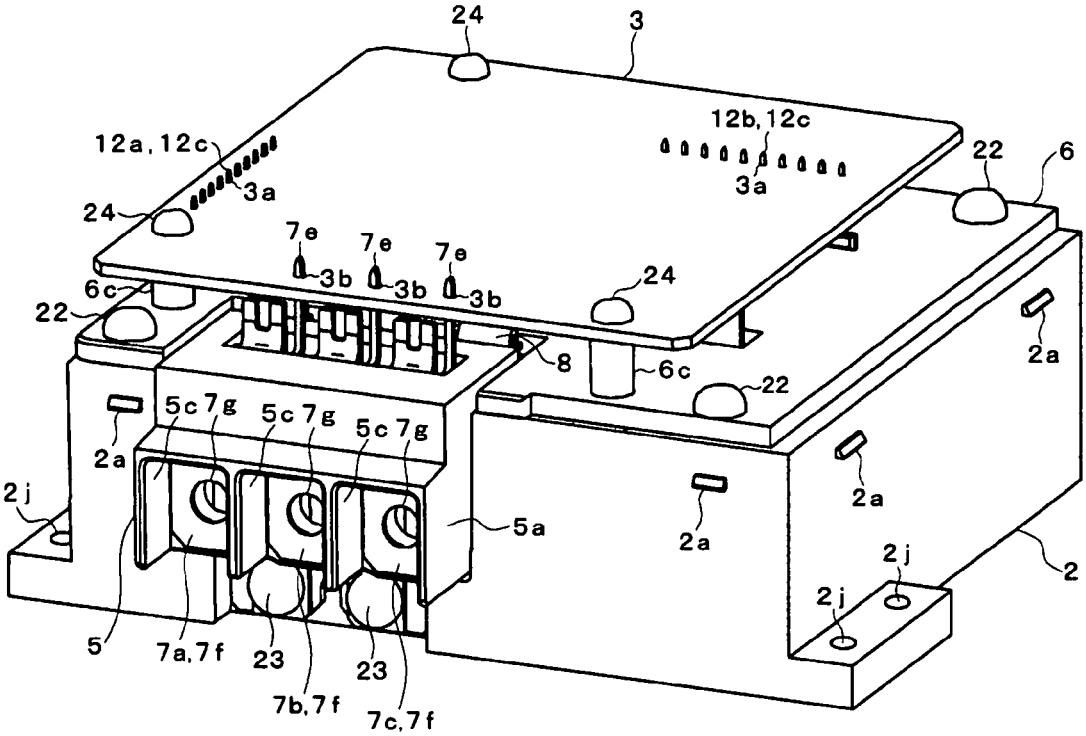
FIG. 11 is a diagram showing an assembly state of the electronic equipment.

Subsequently, the upper end portions of the terminals 11*a* to 11*c* projecting from the holes 5*b* of the connector 5 and the upper end portions 7*d* of the terminals 7*a* to 7*c* are mechanically and electrically connected to one another by spot welding, and the upper end portions of the terminals 11*d* to 11*f* projecting from the holes 6*a* of the base 6 and the upper end portions of the terminals 9*d* to 9*f* are mechanically and electrically connected to one another by spot welding, whereby the power module board 4 is kept to be supported by the base 6. Furthermore, the power module board 4 and the connector 5 are kept to be electrically connected to each other. Subsequently, the respective terminals 12*c* of the connectors 12*a*, 12*b* projecting from the holes 6*b* of the base 6 are made to penetrate through the through holes 3*a* of the control board 3, and also the upper end portions 7*e* of the terminals 7*a* to 7*c* projecting from the holes 5*b* of the connector 5 are made to penetrate through the holes 3*b* of the control board 3, whereby the control board 3 is disposed on the cylinder 6*c* of the base 6. Screws 24 are made to penetrate through holes 3*c* formed in the control board 3, and are threadably mounted in nuts 14 inside of the cylinder 6*c* of the base 6, whereby the control board 3 is fixed to the base 6 and the lower case 2 as shown in FIG. 11. Accordingly, the control board 3 is kept to be supported by the base 6.

Figure 12:
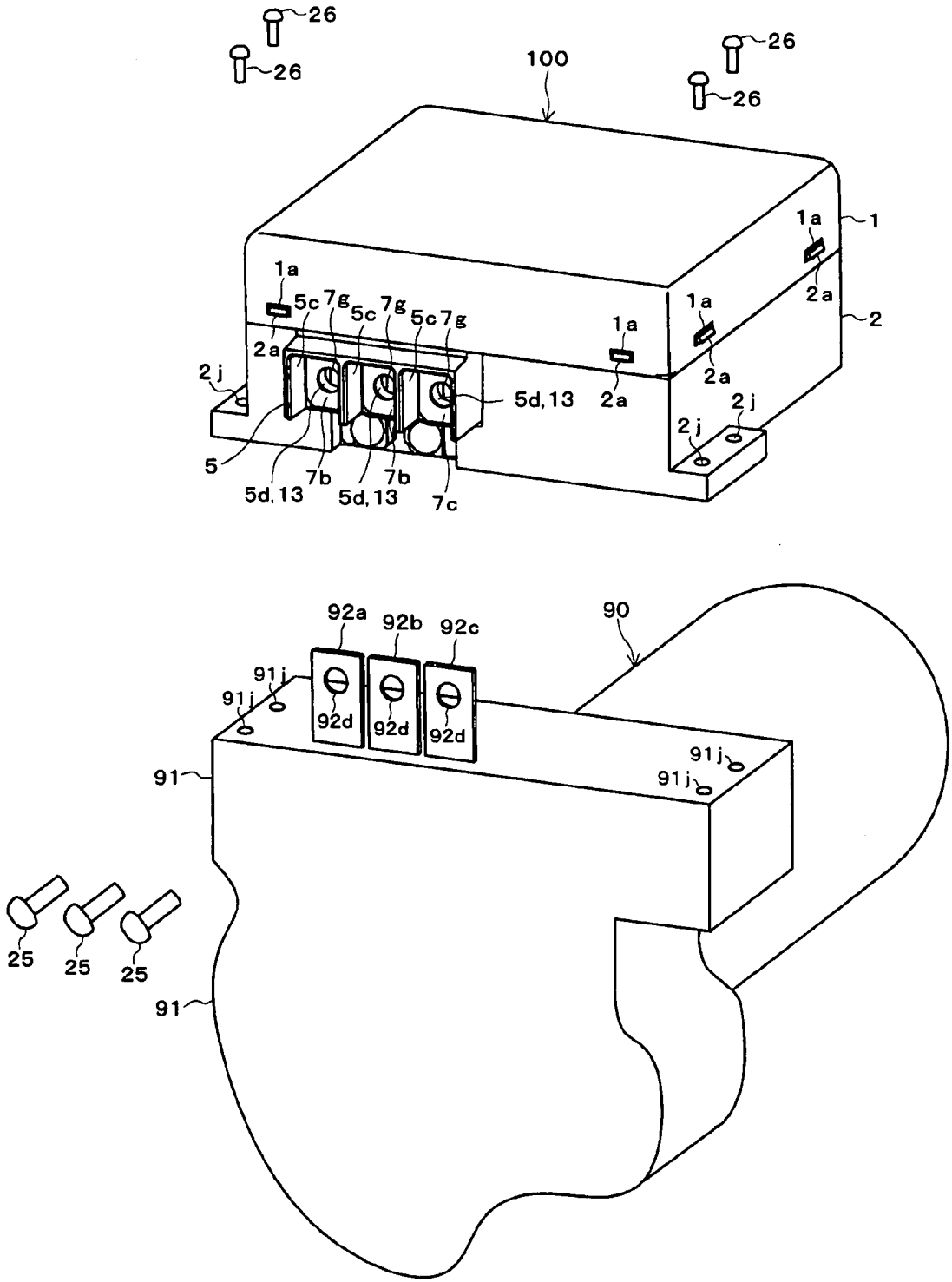
FIG. 12 is a diagram showing an assembly state of the electronic equipment.

Subsequently, the respective terminals 12*c* of the connectors 12*a*, 12*b* projecting from the through holes 3*a* of the control board 3 are electrically connected to the control board 3 by soldering, whereby the control board 3 and the power module board 4 are kept to be electrically connected to each other. Furthermore, the upper end portions 7*e* of the terminals 7*a* to 7*c* of the connector 5 projecting from the holes 3*b* of the control board 3 are electrically connected to the control board 3 by soldering. Subsequently, the connector 10 (omitted from the illustration in FIG. 11) on the control board 3 is engagedly fitted in an opening portion (not shown) of the upper case 1, thereby assembling the lower case 2 and the upper case 1 as shown in FIG. 12. Accordingly, the boards 3, 4 and the base 6 are accommodated in the cases 1, 2 and the connectors 5, 10 are projected from the outside of the cases 1, 2, thereby completing the assembly of the electronic equipment 100.

When the electronic equipment 100 and the electric motor 90 are assembled with each other, motor terminals 92*a* to 92*c* of the electric motor 90 which project from the surface of the case 91 are inserted into the recesses 5*c* of the connector 5 of the electronic equipment 100, and the lower case 2 is mounted on the case 91. Then, the screws 25 are made to penetrate through holes 92*d* formed in the motor terminals 92*a* to 92*c* and holes 7*g* formed in the terminals 7*a* to 7*c* of the connector 5, and threadably mounted in the nuts 13 (see FIG. 8B, etc.) in the holes 5*d* of the connector 5, whereby the motor terminals 92*a* to 92*c* and the terminals 7*a* to 7*c* are brought into close contact with one another. As a result, the electronic equipment 100 and the electric motor 90 are kept to be electrically connected to each other. Furthermore, screws 26 are made to penetrate through holes 2*j* formed in the lower case 2, and threadably mounted in screw holes 91*j* formed in the case 91, whereby the cases 91, 92 are brought into close contact with each other. As a result, the electronic equipment 100 and the electric motor 90 are kept to be connected and fixed to each other.

According to the foregoing description, the connector 5 is fixed to the lower case 2, and the connector 5 is supported through the beam 8 of the flexible metal piece by the base 6. Therefore, even when external force is applied to the connector 5 due to the attachment/detachment of the motor terminals 92*a* to 92*c* to/from the connector 5, the impingement of foreign matters to the connector 5, the dimensional error or assembly error of the respective parts, the difference in thermal shrinkage characteristic among the respective parts or the like, the connector 5 does not jounce (move) with respect to the cases 1, 2, the base 6 and the boards 3, 4, and the external force is absorbed by the beam 8, so that no external force is transmitted to the base 6 and the boards 3, 4. Therefore, stress which may break soldering is not applied to the soldering connection portions of the connector 5 and the boards 3, 4, and thus the connection reliability of the soldering connection portions can be prevented from being lowered.

Furthermore, the connector 5 and the base 6 are formed at the same time in the same insert-molding metal molds 31, 32 by insert molding, so that the manufacturing cost can be reduced. The connector 5 and the base 6 are connected to each other through the beam 8, so that it is unnecessary to carry out the work of assembling the connector 5 to the base 6 and the connector 5 and the base 6 can be assembled to the case 2 and the boards 3, 4 in a lump. Therefore, the number of assembling steps of the electronic equipment 100 can be reduced, and the assembling work can be facilitated.

Furthermore, by providing the bending portions 8*a* to the beam 8, the effective length of the beam 8 by which the beam 8 can sag (the length of the portion of the beam 8 which is exposed from the connector 5 and the base 6, that is, the spring length of the beam 8) can be increased, and the external force applied to the connector 5 can be surely absorbed by the beam 8. In addition, the width dimension W in the direction from the connector 5 of the beam 8 shown in FIG. 7B to the base 6 is reduced, and the interval S between the connector 5 and the base 6 is narrowed, so that the electronic equipment 100 can be miniaturized.

Still furthermore, after the power module board 4, the base 6 and the connector 5 are fixed to the lower case 2, the terminals 7*a* to 7*c* of the connector 5, the terminals 11*a* to 11*f* of the power module board 4 and the terminals 9*d* to 9*f* of the base 6 are connected to one another by spot welding. Therefore, after external force applied to the connector 5 due to the dimensional error or the assembly error of the respective parts is absorbed by the beam 8 so that no external force is transferred to the base 6 and the power module board 4, the power module board 4, the base 6 and the connector 5 can be stably connected to one another. Furthermore, after the control board 3 is fixed to the base 6 subsequently to the power module board 4, the base 6 and the connector 5, the terminals 7*a* to 7*c* of the connectors 5, 12 and the control board 3 are electrically connected to each other by soldering. Therefore, after the external force applied to the connector 5 due to the dimensional error or assembly error of the respective parts is absorbed by the beam 8 so that no external force is transferred to the base 6 and the power module board 4, the connectors 5, 12 and the control board 3 can be stably connected to each other by soldering. Therefore, the stress caused by the external force is not applied to the soldering connection portions, and thus the soldering is not broken, so that the connection reliability of the soldering connection portions can be surely prevented from being lowered.

The present invention may adopt various embodiments other than the above-described embodiment. For example, in the above embodiment, the connector 5 is supported by the base 6 through the metal beam 8 which is insert-molded to the insulating resin of the connector 5 and the base 6. However, the present invention is not limited to the above embodiment. For example, a separate metal leaf spring, rubber or the like may be secured to the connector and the base so that the connector is supported by the base through the leaf spring, rubber or the like. Furthermore, a hinge portion may be formed of insulating resin between the connector and the base in the molding process of the connector and the base so that the connector is supported by the base through the hinge portion. That is, the material of the flexible member of the present invention is not limited to metal insofar as it can absorb external force applied to the connector so that no external force is transferred to the base, the boards, etc.

In the above-described embodiment, the present invention is applied to an electric control device 100 of an electrically motor-drive type power steering device. However, the present invention is not limited to this embodiment, and it may be applicable to other general electronic equipment.

What is claimed is:

1. Electronic equipment comprising:

a connector for electrically connecting a device to be connected;

a board to which the connector is electrically connected and which has a soldering-connection portion;

a base that is overlapped with the board to support the board and the connector; and a case for fixing the connector while the connector is exposed from an opening portion thereof and fixing the board and the base while the board and the base are accommodated therein, wherein the base supports the connector through a flexible member.

2. The electronic equipment according to claim 1, wherein an electrically conductive metal piece constituting the terminal of the connector and a flexible metal piece constituting the flexible member are subjected to insert-molding using insulating resin so that the connector and the base are formed integrally with each other, and then a continuous insulating resin portion is cut out, whereby the connector and the base are connected to each other by only the flexile metal piece.

3. The electronic equipment according to claim 1, wherein the flexible member has a bend portion.

4. The electronic equipment according to claim 1, wherein the board comprises a first board that is supported while overlapped with the upper side of the base, and a second board that is supported while overlapped with the lower side of the base, the first board and the second board are electrically connected to each other by soldering, and the connector is electrically connected to at least one of the first board and the second board by soldering.

5. A method of manufacturing electronic equipment including a connector electrically-connected to a device to be connected, a board having a soldering-connection portion to which the connector is electrically connected, a base for supporting the board and the connector while overlapped with the board, and a case for fixing the connector while the connector is exposed from an opening portion thereof and fixing the board and the base while the board and the base are accommodated in the case, wherein an electrically conductive metal piece constituting a terminal of the connector and a flexile metal piece are subjected to insert-molding using insulating resin so that the connector and the base are formed integrally with each other, and then a continuous resin portion is cut out.

6. The method of manufacturing the electronic equipment according to claim 5, wherein the connector, the board and the base are fixed to the case, and then the connector and the board are electrically connected to each other by soldering.

* * * * *